US008840732B2

(12) United States Patent
Hartmann et al.

(10) Patent No.: US 8,840,732 B2
(45) Date of Patent: Sep. 23, 2014

(54) DISHWASHER WITH AN IMPROVED ARRANGEMENT OF THE FEED DEVICE IN THE DOOR

(75) Inventors: Michael Hartmann, Höchstädt (DE); Dieter Hotz, Dischingen (DE); Cengiz Kücük, Syrgenstein (DE); Michael Rosenbauer, Reimlingen (DE); Bernd Schessl, Dillingen (DE); Erich Schmid, Sontheim a.d.Brenz (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 775 days.

(21) Appl. No.: 12/086,803

(22) PCT Filed: Nov. 28, 2006

(86) PCT No.: PCT/EP2006/068986

§ 371 (c)(1),
(2), (4) Date: Jun. 18, 2008

(87) PCT Pub. No.: WO2007/074007

PCT Pub. Date: Jul. 5, 2007

(65) Prior Publication Data

US 2009/0007943 A1 Jan. 8, 2009

(30) Foreign Application Priority Data

Dec. 23, 2005 (DE) ..... 10 2005 061 994

(51) Int. Cl.
*A47L 15/44* (2006.01)
*A47L 15/42* (2006.01)

(52) U.S. Cl.
CPC ..... *A47L 15/4257* (2013.01); *A47L 15/4409* (2013.01)
USPC ..... 134/56 D; 134/57 D; 134/58 D

(58) Field of Classification Search
USPC ..... 134/56 D, 57 D, 58 D; 222/651, 652
See application file for complete search history.

(56) References Cited

U.S. PATENT DOCUMENTS

| | | | | |
|---|---|---|---|---|
| 3,876,117 | A | 4/1975 | Wright et al. | |
| 4,834,125 | A | 5/1989 | Insalaco | |
| 5,078,077 | A * | 1/1992 | Say | 116/227 |
| 5,310,090 | A | 5/1994 | Taylor, Jr. | |

(Continued)

FOREIGN PATENT DOCUMENTS

DE 100 14 146 9/2001

(Continued)

OTHER PUBLICATIONS

International Search Report PCT/EP2006/068986.

*Primary Examiner* — Michael Barr
*Assistant Examiner* — Benjamin L Osterhout
(74) *Attorney, Agent, or Firm* — James E. Howard; Andre Pallapies

(57) ABSTRACT

A door for a dishwasher, in particular for a domestic dishwasher, the door serving for opening and closing the interior of the dishwasher, comprising an inner door which, when the door is closed, is oriented towards the interior and has a surround comprising a top and a bottom periphery, which run essentially horizontally when the door is closed, and two side peripheries, which run essentially vertically when the door is closed, wherein a feed device for dispensing additives is arranged on the inner door, essentially centrally between the side peripheries and in the top third, in particular in the top quarter, of the region between the top and bottom peripheries.

21 Claims, 3 Drawing Sheets

(56) References Cited

U.S. PATENT DOCUMENTS

| | | | | |
|---|---|---|---|---|
| 5,413,259 | A * | 5/1995 | Cerruti et al. | 222/636 |
| 5,603,431 | A * | 2/1997 | Tuller | 222/63 |
| 5,836,324 | A | 11/1998 | Johnson et al. | |
| 6,622,896 | B2 * | 9/2003 | Hegeman et al. | 222/651 |
| 2003/0106570 | A1 | 6/2003 | Cerruti | |
| 2004/0159339 | A1 * | 8/2004 | Elick et al. | 134/25.2 |

FOREIGN PATENT DOCUMENTS

| | | | | |
|---|---|---|---|---|
| EP | 0 423 044 | 4/1991 | | |
| EP | 0 691 101 | 1/1996 | | |
| EP | 0 858 768 | 8/1998 | | |
| EP | 1 245 180 | 10/2002 | | |
| EP | 1 281 346 | 2/2003 | | |
| EP | 1281346 | A1 * | 2/2003 | A47L 15/44 |
| EP | 1 366 704 | 12/2003 | | |
| EP | 1 374 754 | 1/2004 | | |
| FR | 1435710 | 6/1966 | | |
| FR | 2 593 697 | 8/1987 | | |
| FR | 2 761 254 | 10/1998 | | |
| WO | WO 01/10284 | 2/2001 | | |

* cited by examiner

DISHWASHER WITH AN IMPROVED ARRANGEMENT OF THE FEED DEVICE IN THE DOOR

BACKGROUND OF THE INVENTION

The present invention relates to a dishwasher, in particular a domestic dishwasher, having a washing compartment for holding washable items, means for applying washing liquid to the washable items, and a door for opening and closing the washing compartment, comprising an inner door which is oriented toward the interior of the washing compartment in the closed state of the door and has an upper edge and a lower edge which preferably run essentially horizontally in the closed state of the door and two side edges which preferably run essentially vertically in the closed state of the door, and a feed device for dispensing additives which is arranged on the inner door in the upper third of the region between the upper edge and the lower edge, in particular in the upper quarter.

Dishwashers for cleaning dirty items have an interior in which the dirty items that must be cleaned are placed via a corresponding access opening. After the dirty items have been loaded, the access opening is closed by means of an access door and it is then possible to start the cleaning process, during which in particular water and suitable additives for cleaning the dirty items are supplied to the interior. After the cleaning process is complete, the now cleaned items can be removed from the interior of the dishwasher again by opening the access door.

In the case of dishwashers, what is referred to as a feed device is arranged on the inner side of the access door, said access door being oriented toward the interior in the closed state of the dishwasher. Additives which are supplied to the interior during the execution of the cleaning process and assist the cleaning of the kitchenware are loaded into this feed device. Such additives are e.g. dishwashing agents and rinsing agents.

Various embodiments and positions of the feed devices on an access door of a dishwasher are known from the prior art.

The publication EP 1 281 346 A1 shows a domestic dishwasher having a feed device on the upper side of a frame which is formed on the inner side of the access door. The feed device can be filled from the top side of the frame via a filling opening, and the additive can be dispensed during the cleaning process via a dispensing opening within the frame. The feed device is positioned adjacent to a side edge of the access door.

The publication EP 1 374 754 A1 shows a built-in dishwasher whose access door has an inner door with an outward bulge which extends into an upper region of the access door. Also provided in the upper region is a hollow space in which inter alia a feed device can also be arranged. In this arrangement a feed device which has a single flap is shown, this being arranged in a separate bulge underneath the hollow space. Also shown is a feed device having a filling opening and a dispensing opening, which feed device is integrated in the hollow space. The publication does not specify the positioning of the feed device between the lateral limits of the access door.

The publication DE 37 01 404 A1 discloses a dishwasher having an access door which has a very large receptacle for cleaning agents. The dispensing of the cleaning agent takes place in the lower region of the access door via a feed device which has a cover that can be tilted toward the floor of the interior.

The publication EP 0 858 768 B1 shows a dishwasher having an access door which has an operating panel with a control device and a feed device in its upper section. The feed device is adjacent to a side edge of the access door.

The publication FR 2 761 254 A1 discloses a dishwasher whose feed device is arranged in the central region of the access door.

The document EP 0 423 044 B1 shows a dishwasher having a removable dosing device which can be installed in the upper corner region of the access door of the dishwasher.

The publication US 2003/0106570 A1 discloses a dishwasher having an access door which has a feed device in the upper region of the inner side and adjacent to a side edge of the access door. A similar arrangement of the feed device is described in the publication DE 100 17 073 A1.

WO 01/10284 A1 shows a dishwasher having an access door, wherein the top side of the inner door has filling openings in a corner for the purpose of filling with additives.

EP 1 245 180 A2 schematically shows the inner side of an access door for a dishwasher, wherein the upper region of said inner side has a feed device with filling openings at the top edge and adjacent to a side edge of the access door.

U.S. Pat. No. 4,834,125 shows a dishwasher having an access door whose inner door has an enlarged bulge for expanding the interior of the dishwasher.

The publication U.S. Pat. No. 5,836,324 shows a dishwasher having an access door and a feed device which is arranged in the central region of the access door.

EP 1 366 704 A2 discloses a dishwasher having an access door, wherein a feed device is arranged centrally in the central region of the access door.

EP 0 691 101 B1 describes a dishwasher whose access door has a feed device on the inner side, said feed device being offset relative to a side edge of the door.

All of the access doors described in the prior art have the disadvantage that the feed devices are not optimally positioned in order to ensure an effective and spatially economical layout of the interior of the dishwasher. Furthermore, the feed devices are sometimes constructed in a complex manner and place high demands on the manufacturing of the inner side of the access door.

BRIEF SUMMARY OF THE INVENTION

The object of the invention is therefore to provide a dishwasher having a door which is easy to manufacture and ensures an effective spatial layout of the interior of the dishwasher.

This object is achieved by the invention as claimed. Developments of the invention are defined in the dependent claims.

The dishwasher according to the invention, in particular a domestic dishwasher, having a washing compartment for holding washable items, means for applying washing liquid to the washable items, and a door for opening and closing the washing compartment, comprising an inner door which is oriented toward the interior of the washing compartment in the closed state of the door and has an upper edge and a lower edge which preferably run essentially horizontally in the closed state of the door and two side edges which preferably run essentially vertically in the closed state of the door, and a feed device for dispensing additives which is arranged on the inner door in the upper third of the region between the upper edge and the lower edge, in particular in the upper quarter or in the uppermost region of the upper quarter, said feed device (4) being arranged essentially midway between the side edges (3*c*, 3*d*).

The inventive dishwasher with door has an inner door with a surround, said inner door being oriented toward the interior in the closed state of the access door, wherein the surround comprises an upper edge and a lower edge which preferably run essentially horizontally in the closed state of the access door and two side edges which preferably run essentially vertically in the closed state of the access door. The access door is characterized by a feed device for dispensing additives into the interior of the dishwasher, said feed device being arranged essentially midway between the side edges and in the upper third of the region between the upper edge and the lower edge, preferably even in the upper quarter.

As a result of such positioning, the interior of the dishwasher can firstly be enlarged since the feed device is no longer arranged in the central region of the interior, as is usually the case in the prior art. As a result of the central arrangement in the upper region of the access door, the space in this upper region can additionally be utilized more effectively, since further room can be created laterally adjacent to the feed device by means of corresponding bulges or sloped regions in the inner door. Furthermore, as a result of the central arrangement in the upper region, the access for filling with additive is simplified and, particularly if the dishwasher is installed in a restricted environment, good access to the feed device from a lateral direction is always ensured. Particularly when using a metal sheet for the inner door, simplified manufacturing is ensured as a result of the central arrangement since the corresponding cavities and impressions in the inner sheet can be produced more easily in the case of a symmetrical arrangement. A further advantage is that, as a result of the arrangement of the feed device in the upper region of the inner door in a dishwasher, it is possible to avoid dirtying the feed device when kitchenware is loaded, since the feed device is no longer situated underneath the kitchenware basket when this is withdrawn. Furthermore, efficient flushing of the additives during the cleaning process is ensured as a result of the inventive positioning of the feed device.

In a preferred embodiment of the invention, the feed device is adjacent to the upper edge of the inner door, thereby achieving a particularly large expansion of the interior of the dishwasher. In a further preferred embodiment, the width of the feed device between the side edges is no more than one third of the total width between the side edges. This ensures that sufficient room remains on both sides of the feed device, wherein this room can be utilized for enlarging the interior by means of corresponding bulges.

In a further embodiment of the invention, at least part of the surround which is provided on the inner door juts out toward the interior in the closed state of the access door, and this jutting-out part furthermore fits closely against the edge of a corresponding access opening to the interior in the closed state of the door.

In a further embodiment of the invention, the inner door within the surround has an outward bulge which is oriented away from the interior in the closed state of the access door and serves to enlarge the interior. In this configuration the outward bulge in the region of the feed device preferably slopes toward the upper edge of the surround. This creates a hollow space behind the inner door in which electronic control devices and the like for the dishwasher are preferably accommodated. According to the invention the feed device preferably protrudes from the sloping region of the bulge.

For the purpose of fastening the feed device, a further embodiment of the invention provides for a holder which is oriented toward the interior in the closed state of the access door. The holder preferably extends downward from the upper edge of the surround and has an opening which slopes downward in the closed state of the access door, wherein the feed device is installed into said opening. By virtue of such a design the holder can be formed very easily by means of an impression in the inner door.

In a further embodiment of the invention, the feed device is embodied or arranged in cross-section in such a way that its front side does not stand out beyond the surround front side which is oriented toward the interior. This ensures particularly effective space utilization, since the feed device is prevented from projecting into the interior of the dishwasher.

In a preferred embodiment, the feed device has one or more openings for loading and/or dispensing additives, wherein the openings are preferably situated exclusively within the surround. Consequently, there is only one access to the feed device in the region within the surround. It is therefore possible to do away with further openings, e.g. in the surround itself. The feed device is also preferably embodied in such a way that its openings are provided for both loading and dispensing the additive. The feed device therefore has a simple structure, since it is not necessary to provide separate openings for filling and dispensing.

The feed device preferably has a holder for a cleaning agent which is supplied to assist with the removal of dirt during the cleaning process. In addition, a holder is preferably also provided for rinsing agents. In this arrangement the holder for cleaning agents can preferably be covered by a sliding cover.

In addition to an inner door which forms a wall of the washing compartment in the closed state of the door, the dishwasher according to the invention also has an outer door which serves as a housing or external wall for holding panel parts in the case of integrated dishwashers.

An exemplary embodiment of the invention is described in detail below with reference to the attached drawings, in which:

DETAILED DESCRIPTION OF THE PRESENT INVENTION

Figure 1:
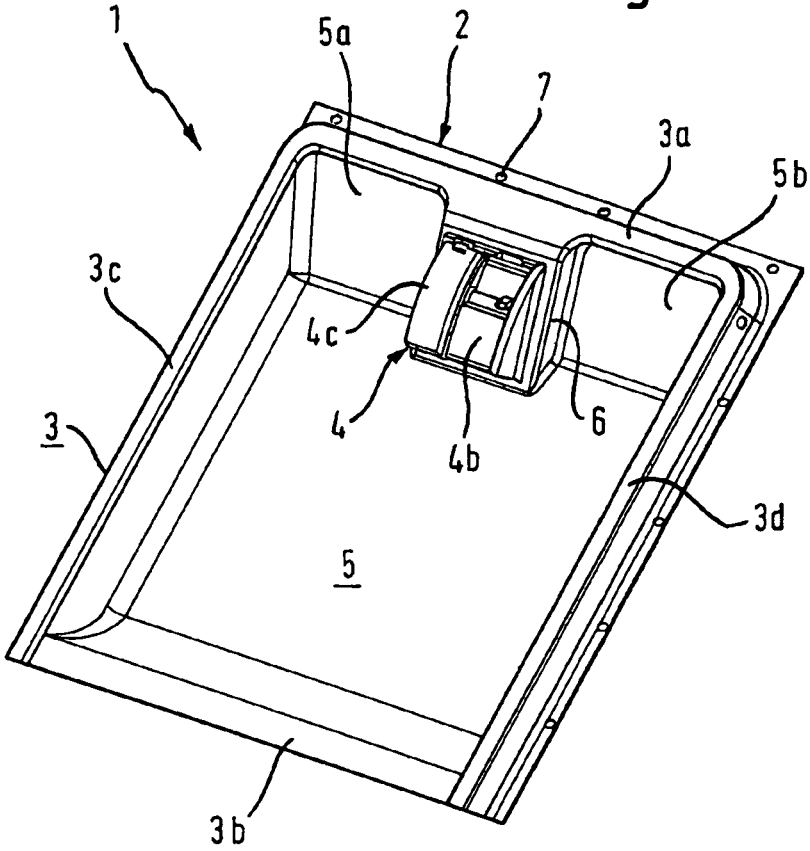
FIG. 1 shows a perspective view of an embodiment of the inner door of a dishwasher according to the invention.

FIG. 1 shows a perspective view of a door 1 for a dishwasher, wherein only the inner door 2 of the door 1 is shown. The inner door consists of an impressed metal sheet in which a surround 3 comprising an upper edge 3*a*, a lower edge 3*b* and two side edges 3*c* and 3*d* is formed. The side edges 3*c* and 3*d* and the upper edge 3*a* essentially form a projecting ridge, and the lower edge 3*b* is offset backward slightly in relation to this ridge. The door 1 is attached to the body of a dishwasher in the region of the lower edge 3*b*, such that a corresponding access opening to the interior of the dishwasher can be opened or closed by means of a pivoting movement of the door. In this type of arrangement the surround 3 serves in particular to seal the interior of the door and in the closed state of the door fits closely against corresponding seals which are provided in the access opening to the interior.

In order further to enlarge the interior of the dishwasher, the inner door 2 has an outward bulge 5 which is oriented away from the interior, wherein a feed device 4 is provided at the upper end of the outward bulge adjacent to the upper edge 3*a*. The feed device is manufactured separately and installed in the inner door 2 subsequently, for which purpose an opening in a holder 6 that is impressed in the door is provided. By virtue of the holder sufficient room is created behind the inner door for accommodating the feed device. According to the invention, the holder essentially extends obliquely from the upper edge 3*a* to the lower floor of the outward bulge 5, such that the opening in the holder slopes downward. As a result of the sloped arrangement, effective flushing of the additives is ensured during the operation of the dishwasher. For the purpose of fastening the inner door to the remainder of the door, holes 7 at the outer edge of the inner door are also provided for attaching corresponding fastening means, in particular screws.

An essential feature of the invention is the central arrangement of the feed device 4 in the upper third of the inner door 2. Firstly, the central region in the interior of the dishwasher is enlarged as a result of this. Secondly, the feed device is now arranged in a region in which components of the dishwasher are already provided, in particular control devices and the operating panel. Existing structural space is therefore utilized for the feed device, this also being made possible in particular because there is now also room for the feed device in the upper region as a result of the decreasing size of electronic components. By virtue of the central arrangement of the feed device, very good access is ensured for filling the device laterally. This is particularly important in the case of a restricted environment. In order that the room to the right and left of the feed device 4 also continues to be used effectively, the feed device has a width which is less than a third of the total width between the side edges 3*c* and 3*d*. Slopes 5*a* and 5*b* can then be formed adjacent to the feed device, running from the floor of the outward bulge 5 to the upper edge 3*a* of the inner door.

The feed device itself comprises a holder 4*a* (FIG. 3) for additives, e.g. softening agents, rinsing agents and/or in particular cleaning agents, e.g. in the form of cleaning tablets, which holder can be closed by means of a sliding cover 4*b*. The additives can be stored and supplied in various forms, e.g. as tablets, powder or liquid (not shown). The holder in FIG. 1 is in the closed position. Also provided is a holder for rinsing agents which is covered by a flip-open cover 4*c*. The holder 4*a* is opened at a specific time during the cleaning process, such that the cleaning agent can reach the interior of the dishwasher and be flushed out of the holder.

Figure 2:
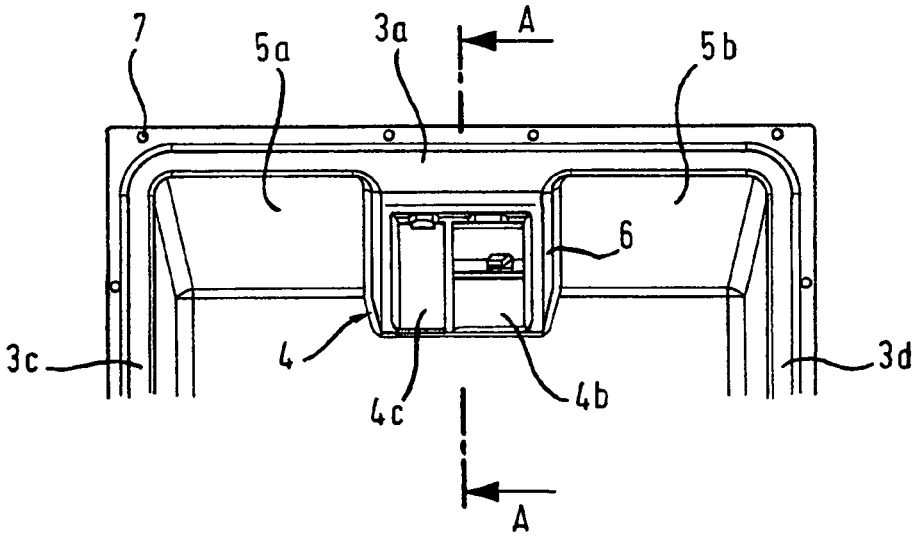
FIG. 2 shows a plan view of the upper region of the inner door from FIG. 1.

FIG. 2 shows a plan view onto the upper region of the door according to FIG. 1. In particular, it is again possible from the figure to see the dimensions of the feed device in comparison with the total width of the inner door. In this context it is evident in particular that the width of the feed device 4 is less than one third of the width between the side edges 3*c* and 3*d*. It is also evident that the feed device is arranged exactly midway between the side edges 3*c* and 3*d*, such that the slopes 5*a* and 5*b* are the same size.

Figure 3:
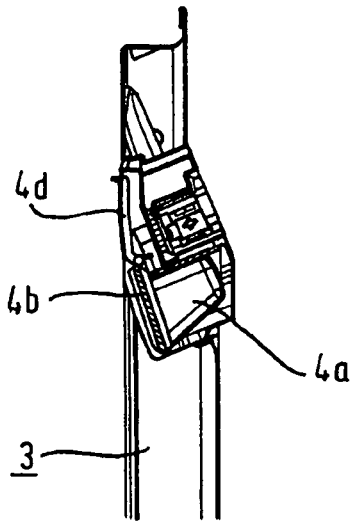
FIG. 3 shows a cross-sectional view along the line A-A from FIG. 2.

FIG. 3 shows a cross-sectional view along the line A-A from the FIG. 2. In particular it is possible here to see the internal shape of the holder 4*a* for the cleaning agent. The holder has a downward sloping floor, thereby ensuring efficient flushing of the additives. It is also possible to see the cover 4*b* which is in the closed position. The cover can be pushed upward via a corresponding guide 4*d* in order to open the holder 4*a* for the purpose of dispensing the additives. The dimensions of the feed device in a vertical direction relative to the inner door of the door are also visible in FIG. 3. It is evident that the major part of the cross-section of the feed device is essentially completely accommodated in the outward bulge 5 in the inner door. Furthermore, the front side of the feed device is essentially flush with the front side of the surround 3.

Figure 4:
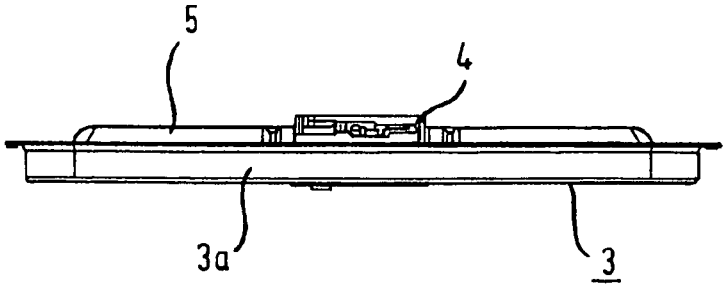
FIG. 4 shows a plan view from above onto the inner door from FIG. 1.

FIG. 4 again shows a plan view from above onto the inner door according to FIG. 1. It can be seen that the floor of the outward bulge 5 is somewhat deeper than the rear of the surround 3, and that the rear side of the feed device projects only slightly beyond the floor of the outward bulge 5. It can also be seen that the front side of the feed device barely projects beyond the front side of the surround.

LIST OF REFERENCE NUMERALS

1 Door.
2 Inner door
3 Surround
3*a* Upper edge
3*b* Lower edge
3*c*, 3*d* Side edges
4 Feed device
4*a* Holder for cleaning agents
4*b* Sliding cover
4*c* Flip-open cover
4*d* Guide
5 Outward bulge
5*a*, 5*b* Slope
6 Holder
7 Holes

The invention claimed is:

1. A dishwasher, including a domestic dishwasher, having a washing compartment defining an interior chamber for holding washable items for washing, the interior chamber including an access opening defined therein for user access to the washing compartment; an arrangement for applying washing liquid to the washable items; and a door for selectively covering and uncovering the access opening to the washing compartment, the dishwasher comprising:

an inner door portion mounted to the door and oriented toward the interior chamber when the door is closed, the inner door portion including a surround to seal the washing compartment, the surround having an upper edge extending substantially horizontally when the door is closed and a lower edge extending substantially horizontally when the door is closed and two side edges extending orthogonally to the respective upper edge and lower edge with each side edge extending substantially vertically when the door is closed, the inner door portion including an outward bulge directed away from the interior chamber when the door is closed, the outward bulge including a sloping region extending between the upper edge and a lower floor of the outward bulge; and a feed device installed on the sloping region of the outward bulge adjacent the upper edge to dispense additives, the feed device being disposed on the inner door portion in an upper third of a region defined to extend between the upper edge and the lower edge, wherein the feed device is disposed essentially midway between the side edges, and wherein the feed device has at least one opening for both loading additives and dispensing additives, and the at least one opening is disposed in an area positioned inwardly of the surround, wherein the surround comprises a ridge on each of the upper edge and the two side edges.

2. The dishwasher according to claim 1 wherein the at least one opening is positioned so as to be encircled by the surround.

3. The dishwasher according to claim 1 wherein the feed device has a width that is no more than one third of the total distance between the side edges.

4. The dishwasher according to claim 1 wherein at least part of the surround projects outwardly toward the interior chamber when the door is closed, and fits closely against an edge of the access opening to the interior chamber.

5. The dishwasher according to claim 1 wherein the outward bulge is disposed within the surround.

6. The dishwasher according to claim 1 wherein the feed device is installed in a holder which extends obliquely from the upper edge to the lower floor of the outward bulge.

7. The dishwasher according to claim 6 wherein the feed device projects from the sloping region of the outward bulge.

8. The dishwasher according to claim 1 wherein the feed device is arranged in a holder which projects into the interior chamber when the door is closed.

9. The dishwasher according to claim 8 wherein the holder extends downwardly from an upper edge of the surround.

10. The dishwasher according to claim 8 wherein the holder is formed with an opening into which the feed device is installed, wherein a holder structure forming the opening slopes downwardly when the door is closed.

11. The dishwasher according to claim 8 wherein the holder is formed by an impression in the inner door portion.

12. The dishwasher according to claim 1 wherein the at least one opening is provided for both loading and dispensing the additive.

13. The dishwasher according to claim 1 wherein the feed device includes a holder for cleaning agents.

14. The dishwasher according to claim 13, in which the feed device includes a holder for rinsing agents.

15. The dishwasher according to claim 13 wherein the holder for cleaning agents includes a sliding cover for covering the holder for cleaning agents.

16. The dishwasher according to claim 13, wherein the holder extends obliquely from the upper edge to the lower floor of the outward bulge.

17. The dishwasher according to claim 1 wherein the interior chamber of the dishwasher can be accessed through the access opening in a generally horizontal direction and/or the door is mounted to the lower region of the dishwasher using a hinge such that it can be pivoted about a generally horizontal axis.

18. The dishwasher according to claim 1 wherein the door includes an outer door portion.

19. The dishwasher according to claim 1, wherein the ridge comprises a gasket.

20. The dishwasher according to claim 1, wherein the feed device protrudes from the sloping region of the outward bulge.

21. The dishwasher according to claim 1, wherein the feed device, in a cross-sectional view, does not protrude beyond the ridges of the surround in a direction toward the interior chamber when the door is closed.

* * * * *